US008286296B1

(12) United States Patent
Nakamura et al.

(10) Patent No.: US 8,286,296 B1
(45) Date of Patent: Oct. 16, 2012

(54) FOLDED HAND TOWEL WITH UPPER PORTION USED AS AN ICE AND BEVERAGE HOLDER POCKET AND LOWER PORTION WETTED BY GRAVITY FOR CLEANING GOLF RELEASED ITEMS

(76) Inventors: Derek Nakamura, Denver, CO (US); Megian S. Nakamura, Denver, CO (US)

( * ) Notice: Subject to any disclaimer, the term of this patent is extended or adjusted under 35 U.S.C. 154(b) by 491 days.

(21) Appl. No.: 12/587,904

(22) Filed: Oct. 16, 2009

(51) Int. Cl.
*B32B 3/04* (2006.01)
*A63B 47/00* (2006.01)

(52) U.S. Cl. ..... 15/210.1; 15/209.1; 206/315.9

(58) Field of Classification Search ..... 15/210.1, 15/104.93, 209.1; 206/315.9; 224/919
See application file for complete search history.

(56) References Cited

U.S. PATENT DOCUMENTS 2,968,825 A * 1/1961 Wetherby ..... 15/118
5,012,543 A * 5/1991 Lewis, Sr. ..... 15/209.1
5,443,880 A * 8/1995 Wike ..... 428/78
5,770,284 A * 6/1998 Logemann ..... 428/36.1
5,804,279 A * 9/1998 Pluth ..... 428/124
5,817,379 A * 10/1998 Rich et al. ..... 428/35.2
6,560,812 B1 * 5/2003 Pettway ..... 15/210.1

* cited by examiner

*Primary Examiner* — Shay Karls
(74) *Attorney, Agent, or Firm* — Edwin H. Crabtree; Ramon L. Pizarro

(57) ABSTRACT

A folded hand towel having an upper towel portion used as an ice and beverage holder pocket and adapted for attaching to a golf bag. Ice cubes received in the pocket and when melted, provide moisture for wetting a lower towel portion for cleaning golf related items. The upper towel portion is divided from the lower towel portion by horizontal stitching across the width of the towel. Vertical edges of the upper towel portion are stitched together to form an open top ice and beverage holder pocket. The inside of the pocket includes an open top and an open bottom, water-proof liner. The liner is attached to opposite sides of the upper towel portion. The liner helps keep items stored therein cool and also prevent moisture from the ice from wetting the opposite sides of the upper towel portion. The open bottom of the liner allows moisture from the melted ice to migrate downwardly be gravity and wet the opposite sides of the lower towel portion.

11 Claims, 2 Drawing Sheets

FOLDED HAND TOWEL WITH UPPER PORTION USED AS AN ICE AND BEVERAGE HOLDER POCKET AND LOWER PORTION WETTED BY GRAVITY FOR CLEANING GOLF RELEASED ITEMS

BACKGROUND OF THE INVENTION (a) Field of the Invention

This invention relates to a hand towel used as an ice and beverage holder and more particularly, but not by way of limitation, to a hand towel folded vertical in half with an upper towel portion used as an ice and beverage holder pocket and a wetted lower towel portion used for cleaning a golf ball, a golf club and related golf items.

(b) Discussion of Prior Art

In U.S. Pat. No. 5,770,284 to Logemann, a golf towel with pocket is disclosed having a metal clip for attaching to the side of a golf bag. The towel includes an upper pocket for storing various golf related items and a folded towel extending downwardly from the bottom of the pocket. In U.S. Pat. No. 2,968,825 to Wetherby, a golf ball cleaner is illustrated having a water-proof upper pocket with a moistened liner used for cleaning a golf ball received inside the pocket. The ball cleaner also includes a lower towel portion used for drying the cleaned golf ball. In U.S. Pat. No. 5,804,279 to Pluth, a detailing towel having lower pockets for holding a sponge and like cleaning items is described. In U.S. Pat. No. 5,817,379 to Rich et al., a double-sided towel having a moisture absorbent side and a moisture impervious side is disclosed. The towel can be used in a fitness center as a bag for carrying damp clothing. Also, in U.S. Pat. Nos. 5,443,880 to Wike and 5,012,543 to Lewis, Sr. a beach towel and an athletic towel with pockets for carrying accessory items are illustrated.

None of the above mentioned patents disclose the unique features, structure and function of the subject folded hand towel having an upper towel portion used as an ice and beverage holder pocket and adapted for attaching to a golf bag. Ice cubes received in the pocket and when melted, provide moisture for wetting a lower towel portion for cleaning golf related items.

SUMMARY OF THE INVENTION

In view of the foregoing, it is a primary objective of the subject invention to provide a vertically folded hand towel having an upper towel portion used as an ice and beverage holder pocket. The upper portion adapted for attaching to a golf bag and suspended therefrom. The holder pocket provides for allowing melted ice to drain downwardly by gravity and wet a lower towel portion of the folded towel. The wet, lower towel portion is used for cleaning various golf items when playing a game of golf.

Another object of the invention is the pocket in the upper towel portion of the folded towel includes a water-proof insulation liner. The liner helps keep cool food and beverage items stored therein during a round of golf The subject invention includes a hand towel folded vertically in half and having an upper towel portion and a lower towel portion. The upper towel portion is divided from the lower towel portion by horizontal stitching across the width of the towel. Vertical edges of the upper towel portion are stitched together to form an open top ice and beverage holder pocket. The inside of the pocket includes an open top and an open bottom, water-proof liner. The liner is attached to opposite sides of the upper towel portion. The liner helps keep items stored therein cool and also prevent moisture from the ice from wetting the opposite sides of the upper towel portion. The open bottom of the liner allows moisture from the melted ice to migrate downwardly be gravity and wet the opposite sides of the lower towel portion. This feature provides a wet towel surface for cleaning various golf related items.

These and other objects of the present invention will become apparent to those familiar with ice and beverage holders and items used for cleaning golf balls, golf clubs and golf related items when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
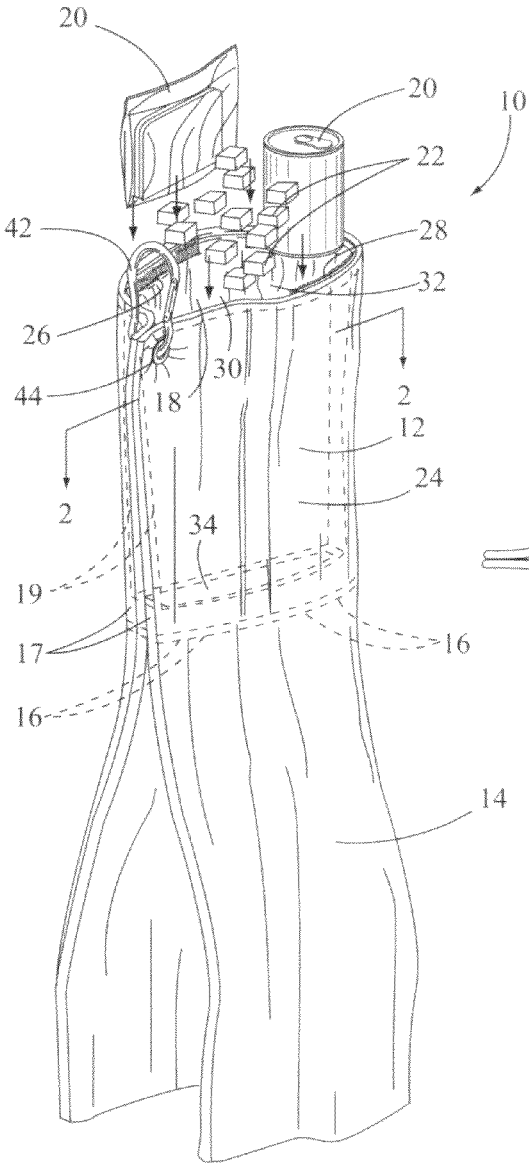
FIG. 1 is a perspective view of the folded hand towel with an upper and lower towel portion. The upper towel portion is shown opened for receiving ice cubes and food and beverage items to be stored inside an ice and beverage holder pocket.

In FIG. 1, a perspective view of the subject vertically folded hand towel is shown having general reference numeral 10. The hand towel 10 includes an upper towel portion 12 and lower towel portion 14 divided in half by horizontal stitching 16. Also, side edges 17 of the upper towel portion 14 are stitched together using vertical stitching 19.

Figure 3:
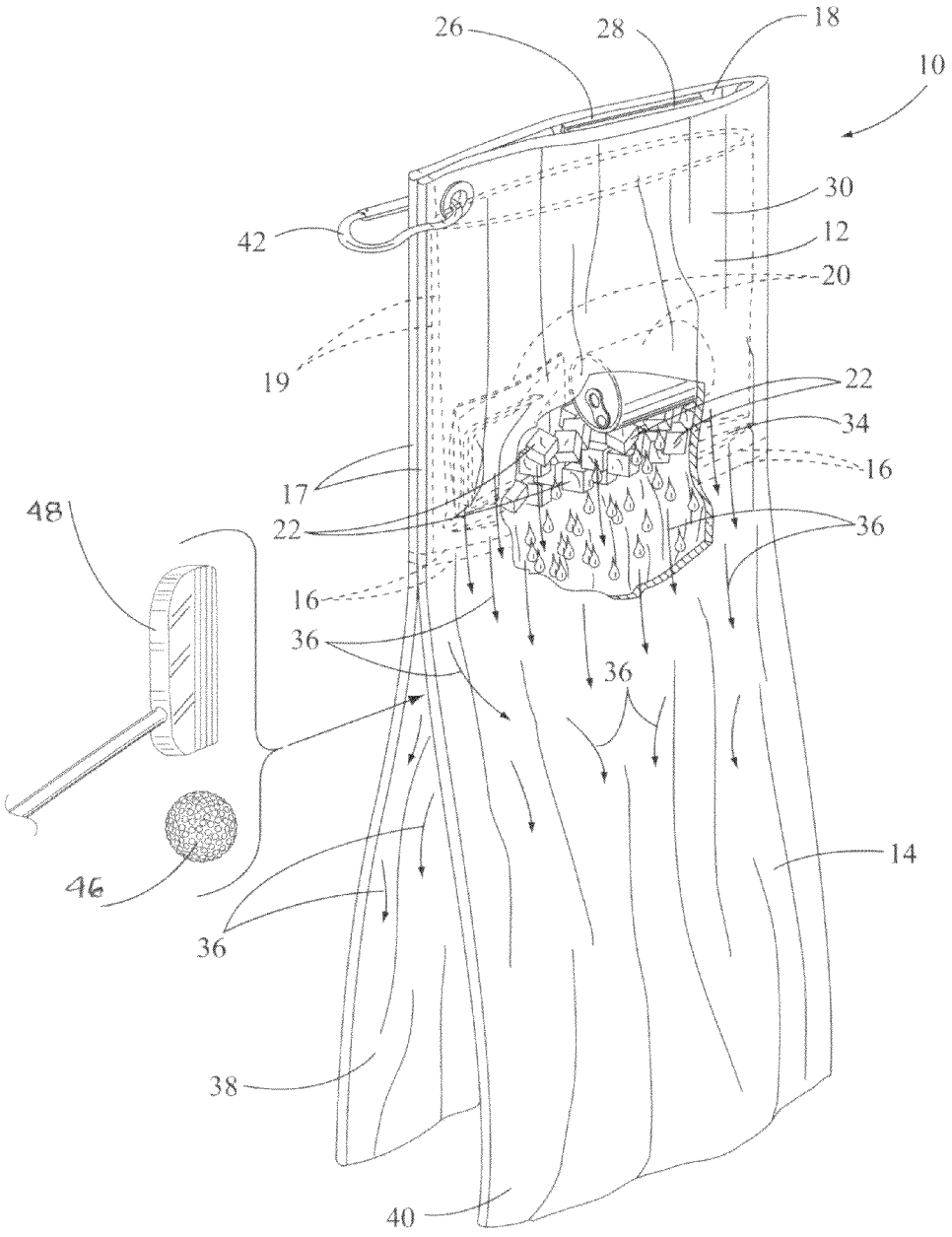
FIG. 3 is another perspective view of the folded hand towel with the upper towel portion closed, using hook and loop fasteners, and ice cubes inside the pocket melting to illustrate the migration of moisture from the bottom of the pocket downwardly by gravity into the lower towel portion. The wetted, lower towel portion is used for cleaning various golf items.

In this drawing, the upper towel portion 12 is shown having an open top 18 for receiving various food and beverage items 20 and ice cubes 22 to be stored inside an ice and beverage holder pocket 24. Also, opposite sides of the upper edges of the hand towel 10 include a strip of hook fasteners 26 and a strip of loop fasteners 28, which are used to close the open top 18, as shown in FIG. 3.

The inside of the pocket 24 includes an insulated, water-proof liner 30 having an open top 32 and an open bottom 34. The liner 30 is attached to opposite insides of the upper towel portion 12. The liner 30 is designed to help keep the food and beverage items 20 stored therein cool during a round of golf and also prevents moisture from the ice cubes 22 from wetting the opposite sides of the upper towel portion 12. But, the open bottom 34 of the liner 30 does allow moisture from the melted ice cubes 22, as indicated by arrows 36 shown in FIG. 3, to migrate downwardly be gravity and wet a first side 38 and second side 40 of the lower towel portion 14. The horizontal stitching 16 is not water tight and therefore allows the melted water from the ice cubes to saturate the lower towel portion 14. This feature provides the necessary wet towel surface for cleaning various golf related items.

Also shown in this drawing is a metal loop fastener 42 received through a grommet 44 attached to one side of the top of the upper towel portion 12. The metal loop fastener 42 is used for releasable attachment of the folded hand towel 10 to the side of a golf bag. The golf bag isn't shown in the drawings.

Figure 2:
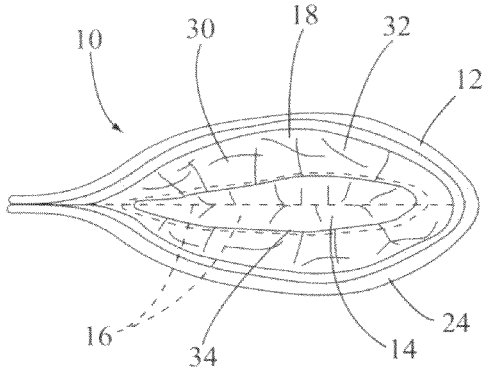
FIG. 2 is a sectional view of the upper towel portion taken along lines 2-2 shown in FIG. 1. In this drawing, the liner is shown attached to the opposite sides of the upper towel portion with the liner having an open bottom for allowing moisture from melted ice to migrate downwardly for wetting the lower towel portion.

In FIG. 2, a sectional view of the upper towel portion is shown and taken along lines 2-2 in FIG. 1. In this drawing, the sides of the liner 30 are shown attached to the opposite sides of the upper towel portion 12 with the liner having the open bottom 34. As mentioned above, the open bottom 34 of the liner 30 allows moisture from melted ice cubes 22 to migrate downwardly by gravity for wetting the lower towel portion 14.

In FIG. 3, another perspective view of the folded hand towel 10 is shown with the open top 32 of the liner 30 closed, using the hook and loop fasteners 26 and 28. In this view, the ice cubes 22 inside the pocket 24 are shown melting to illustrate the migration of moisture, as indicated by arrows 36, from the open bottom 34 of the liner 34 downwardly by gravity, past the horizontal stitching 16, into the lower towel portion 14 and wetting the first and second sides 38 and 40 for cleaning a golf ball 46, a golf putter head 48 and other golf items.

While the subject invention has been discussed for use in cleaning various golf items, it's obvious that the folded hand towel 10 can be used equally well for other indoor and outdoor sport activities for holding food and beverage items and cleaning sports equipment.

The embodiments of the invention for which as exclusive privilege and property right is claimed are defined as follows:

1. A folded hand towel adapted for holding ice cubes and food and beverages and adapted for cleaning golf club items, the hand towel comprising:

an upper towel portion having an open top pocket formed therein, the pocket adapted for receiving and storing the ice cubes and food and beverages therein; and a lower towel portion, the lower towel portion divided from the upper towel portion by horizontal stitching across the width thereof; and an open top and an open bottom, water-proof liner, the liner received in the pocket and attached to opposite sides of the upper towel portion, the liner adapted for keeping items stored therein cool and prevent moisture from the ice cubes from wetting the opposite sides of the upper towel portion, the open bottom of the liner allows moisture from the melted ice to migrate downwardly be gravity and wet the lower towel portion;

whereby, the lower towel portion is adapted for receiving moisture from melted ice cubes in the pocket for wetting the lower towel portion, the wet lower towel portion adapted for cleaning golf related items.

2. The folded hand towel as described in claim 1 wherein side edges of the upper towel portion include vertical stitching for forming the pocket therein.

3. The folded hand towel as described in claim 1 further including hook and loop fasteners attached to sides of the upper towel portion for closing together the open top pocket in the upper towel portion.

4. The folded hand towel as described in 1 having a releasable metal fastener attached to a top of the upper towel portion, the metal fastener adapted for securing the folded hand towel to a golf bag.

5. The folded hand towel as described in claim 1 wherein the lower towel portion includes a first side and a second side, the first and second side when wet adapted for cleaning the golf club items.

6. A folded hand towel adapted for holding ice cubes and food and beverages and adapted for cleaning golf club items, the hand towel comprising:

an upper towel portion having an open top pocket formed therein, the pocket adapted for receiving and storing the ice cubes and food and beverages therein;

a lower towel portion, the lower towel portion divided from the upper towel portion by horizontal stitching across the width thereof; and an open top and an open bottom, insulated, water-proof liner, the liner received in the pocket and attached to opposite sides of the upper towel portion, the liner adapted for keeping items stored therein cool and prevent moisture from the ice cubes from wetting opposite sides of the upper towel portion, the open bottom of the liner allows moisture from the melted ice to migrate downwardly be gravity, past the horizontal stitching, and wet the lower towel portion.

7. The folded hand towel as described in claim 6 wherein side edges of the upper towel portion include vertical stitching for forming the pocket therein.

8. The folded hand towel as described in claim 6 further including hook and loop fastener strips attached to the open top of opposite sides of the upper towel portion for closing together the open top pocket in the upper towel portion.

9. The folded hand towel as described in claim 6 having a releasable metal Fastener and grommet attached to a top of the upper towel portion, the metal fastener adapted for securing the folded hand towel to a golf bag.

10. The folded hand towel as described in claim 6 wherein the lower towel portion includes a first side disposed next to a second side, the first and second side when wet adapted for cleaning the golf club items received therebetween.

11. A folded hand towel adapted for holding ice cubes and food and beverages and adapted for cleaning golf club items, the hand towel comprising:

an upper towel portion having an open top pocket formed therein, the pocket adapted for receiving and storing the ice cubes and food and beverages therein, side edges of the upper towel portion include vertical stitching for forming the pocket therein;

hook and loop fastener strips attached to an open top of opposite sides of the upper towel portion for closing together the open top pocket in the upper towel portions;

a lower towel portion, the lower towel portion divided from the upper towel portion by horizontal stitching across the width thereof, the lower towel portion including a first side disposed next to a second side, the first and second side when wet adapted for cleaning the golf club items received therebetween; and an open top and an open bottom, insulated, water-proof liner, the liner received in the pocket and attached to opposite sides of the upper towel portion, the liner adapted for keeping items stored therein cool and prevent moisture from the ice cubes from wetting opposite sides of the upper towel portion, the open bottom of the liner allows moisture from the melted ice to migrate downwardly be gravity, past the horizontal stitching, and wet the lower towel portion.

* * * * *